United States Patent [19]

VanLierop

[11] Patent Number: 4,659,066

[45] Date of Patent: Apr. 21, 1987

[54] SCISSOR JACK

[75] Inventor: John G. M. VanLierop, Mississauga, Canada

[73] Assignee: 554072 Ontario Inc., Mississauga, Canada

[21] Appl. No.: 704,696

[22] Filed: Feb. 25, 1985

[51] Int. Cl.[4] ..... B66F 3/00

[52] U.S. Cl. ..... 254/122

[58] Field of Search ..... 187/8.43, 18; 254/122, 254/9 C, 90, 124; 182/63, 141, 148, 69

[56] References Cited

U.S. PATENT DOCUMENTS

| | | | |
|---|---|---|---|
| 219,850 | 9/1879 | Drian et al. | 187/18 |
| 2,909,358 | 10/1959 | Southerwick | 254/2 B |
| 2,945,551 | 7/1960 | Annin et al. | 187/18 |
| 3,329,240 | 7/1967 | Harwood et al. | 187/95 |
| 4,092,011 | 5/1978 | Luebke | 254/122 |
| 4,347,916 | 9/1982 | Schroder | 187/95 |
| 4,447,042 | 5/1984 | Masvi | 187/8.43 |
| 4,491,201 | 1/1985 | Mountz | 187/8.43 |

FOREIGN PATENT DOCUMENTS

| | | | |
|---|---|---|---|
| 2341515 | 9/1977 | France | 187/8.43 |

*Primary Examiner*—Robert C. Watson

*Attorney, Agent, or Firm*—Rogers, Bereskin & Parr

[57] ABSTRACT

A jack is provided for use with a lifting device having two parallel support platforms. The jack has base and top elements, and a scissor mechanism between them. At least one air piston and cylinder assembly actuates the scissor mechanism. To ensure that the jack can be freely moved along the length of a lifting device, a plurality of horizontal rollers and a plurality of vertical rollers are provided. The horizontal rollers are mounted by spring biasing means, so that, when a vehicle weight is taken by the jack, the spring means is compressed. The jack then contacts the support platforms, to prevent further movement of it. The jack can also include two vertical air piston and cylinder assemblies, which are connected on either side of the scissor mechanism.

12 Claims, 3 Drawing Figures

SCISSOR JACK

This invention relates to a jack, for use with a lift, for cars and other vehicles, to enable a variety of maintenance work to be carried out.

At the present time, there is available a wide variety of devices for lifting vehicles. Generally, these devices can be split into two categories. In one category, a vehicle is lifted by its wheels, whilst in a second category the vehicle is supported by its chassis or bodywork, with its wheels hanging freely.

The first category of lifting device is necessary for carrying out alignment work. Alignment involves adjusting the steering mechanism of a vehicle, to ensure that the wheels are properly aligned. It cannot be carried out with the wheels hanging freely. It has to be carried out with the suspension loaded to its usual working position. To this end, so-called alignment racks are provided. These include rotatable turnplates on which the front or steering wheels of the vehicles are located. Then, without moving the vehicle, the steering wheels can be readily turned, to adjust the alignment etc. Usually, the vehicle is lifted by the alignment rack, to give free access to the steering mechanism underneath the vehicle. However, such alignment racks are unsuited for many other types of work. If parts of the suspension mechanism needs to be replaced, or if the brakes of the vehicle require work, then it is necessary to support the vehicle, with the wheels and suspension hanging freely. Such work cannot be carried out on conventional alignment racks.

The second category of lifting devices are used for carrying out a variety of maintenance work on vehicles. Many current designs include two or four posts above the ground. In these posts, a variety of somewhat complex mechanisms including, for example, hydraulic cylinders and chains are provided. The mechanism is connected to a platform for lifting a vehicle. In use, a vehicle is positioned above the platform. The platform includes movable supports, which are located beneath the support points of the chassis of the vehicle etc.. Then, the mechanism in the posts can be used to lift the platform and vehicle up. This, then lifts the vehicle, with the wheels hanging freely, so one can readily work on the brake system, etc. However, such a lifting device has a number of disadvantages. It does not enable alignment work to be carried out, as the steering wheels are hanging freely. Also, whilst such a lifting mechanism provides free access underneath a vehicle, the provision of posts requires a lot of space. The mechanisms included often require a lot of maintenance.

It is desirable that a lifting device or hoist for a vehicle should enable all types of work on the vehicle to be carried out. Further, the device should not obstruct the area underneath the vehicle, so as to provide free access. The device should occupy as little space as possible and require minimum maintenance. Also, preferably the device should not require a pit to be dug or other expensive installation work.

Our co-pending patent application No. 704,791: describes and claims a lifting device, which includes two separate scissor units, for lifting separate support platforms for the wheels of a vehicle. As such, it is expected to provide a simple, robust lifting device, which does not require a pit to be dug for its installation.

The basic lifting device is arranged to lift a vehicle by its wheels. This is suitable for carrying out alignment work, and many other types of work. However, for carrying out work on the brakes, suspension etc., it is necessary to lift the wheels clear of the support platforms. Preferably, this is achieved, without requiring a fully separate lifting unit, capable of lifting the weight of the entire vehicle to the required height.

In accordance with the present invention, there is provided a jack for use with a lifting device including two parallel support platforms, the jack comprising a base element, a top element, a scissor mechanism between the base and top elements, at least one air piston and cylinder assembly for displacing the top element vertically relative to the base element, a plurality of vertical rollers, for engaging sides of the support platforms to guide the jack therebetween, a plurality of horizontal rollers for engaging top surfaces of sides of the support platforms for horizontal movement of the jack, and spring biasing means mounting the horizontal rollers to the base element, the spring biasing means being such that, when a pre-determined load is applied to the jack, the base element is displaced downwards to contact the support platforms, thereby to restrict further horizontal movement of the jack.

In accordance with another aspect of the present invention, there is provided a jack for use with a lifting device including two parallel support platforms, the jack being adapted for horizontal movement between the support platforms and comprising a base element, a top element, a scissor mechanism between the base and top elements, and two air piston and cylinder assemblies, which are disposed vertically and are pivotally connected to either side of the scissor mechanism for displacing the top element vertically relative to the base element.

Provision of both horizontal and vertical rollers can greatly facilitate movement of the jack. The jack can be quite a heavy component. Further, its length along the axis of a lifting device is usually much less than its width. As a result, with known jacks, it is quite easy for them to become jammed, if they are not handled carefully. With the jack of the present invention, even if an operator applies a force at one end, the rollers should still ensure that it travels freely between the two support platforms. Also, the mounting of the horizontal rollers by spring biasing means enables the jack to be automatically locked in position when a vehicle weight is taken by it.

The other aspect of the present invention, which can be provided separately or together with the above-mentioned aspect, enables a jack to be compact and efficient. By providing two air piston and cylinder assemblies on either side of the scissor mechanism, the two assemblies can provide uniform forces to the jack. Further, they can be arranged so that they apply loads to the scissor mechanism in the most mechanically advantageous manner possible. It is also possible to arrange for piston and cylinder assemblies having a relatively short stroke, to give the jack a relatively large travel.

For a better understanding of the present invention, and to show more clearly how it may be carried into effect, reference will now be made, by way of example, to the accompanying drawings, which show a preferred embodiment of the present invention, and in which.

Figure 1:
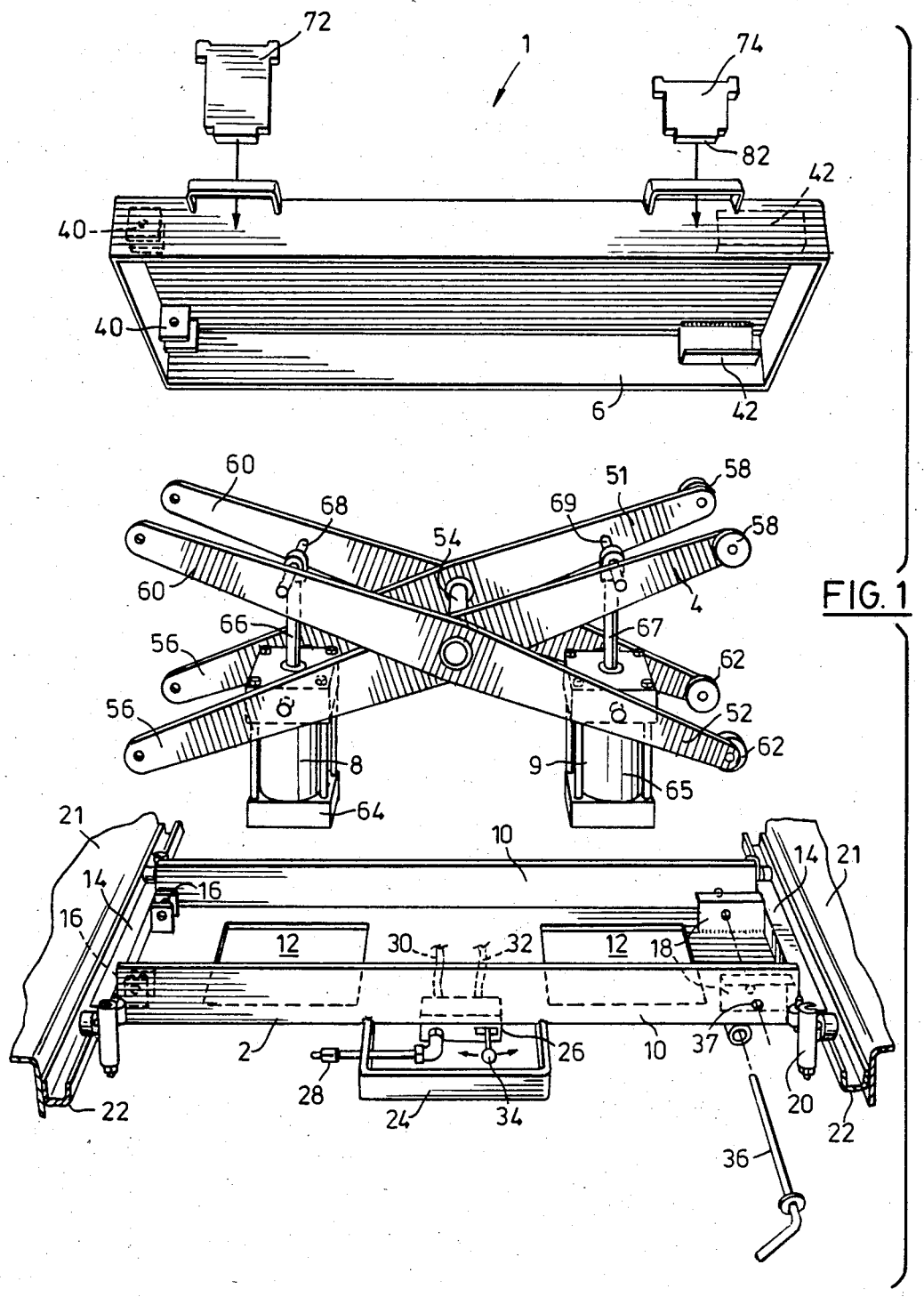
FIG. 1 shows a perspective, exploded view of a jack in accordance with the present invention.

With reference to FIG. 1, there is shown a jack generally denoted by the reference 1. The jack 1 comprises four principal elements, namely a base element 2, a scissor mechanism 4, a top element 6, and air piston and cylinder assemblies 8,9.

The base element 2 is formed from heavy gauge sheet steel. The base element 2 is generally rectangular, with parallel, turned-up side edges 10. It includes two square openings 12, to accomodate the air piston and cylinder assemblies 8, 9, as detailed below. Along either edge of the base element 2, there is secured an angle section member 14. The angle section member 14 can be welded to the main body of the base element 2.

At the lefthand end of the base element 2, two pairs of rectangular plates with holes are welded to it, to form two pivot locations 16. At the righthand end of the base element 2, two inverted L-section members 18 are provided. These members 18 are welded to the element 2, to form respective channels for rollers.

At each of the four corners of the base element 2, there is provided a roller assembly 20. Each of these roller assemblies 20 is described in detail below. The roller assemblies 20 are adapted to travel along sides of support platforms of a hydraulic lift or hoist, these support platforms being shown partially at 21. Along the inner edges of these support platforms 21, there are channel-section members 22, parts of which are visible in FIG. 1. The roller assemblies 20 engage these channel-section members 22.

The base element 2 also includes a handle 24 which is generally rectangular and welded thereto. The handle 24 serves to protect a control valve 26 for compressed air. As indicated at 28, there is an inlet for compressed air, and the valve 26 has two outlet lines 30, 32 for connection to the air piston and cylinder assemblies 8, 9. The actual lines between the outlets 30, 32 and the assemblies 8, 9 can be of known construction and are not shown in detail. The control valve 26 includes an operating lever 34, which can be operated as indicated by the arrows.

The top member 6 generally corresponds to the base element 2, and is slightly larger, so as to enclose it, when the jack 1 is in a closed configuration. The top member 6 is also formed from heavy gauge sheet steel. Edge portions of the top member 6 are turned down and welded together, to form a continuous periphery. At the lefthand end of the top element 6, as viewed in FIG. 1, there are two pairs of rectangular plates with holes, forming pivots 40. At the right hand end of the top element 6, two L-section members 42 are welded in position to form respective channels for rollers. Further details of the top element 6 are given below.

The scissor mechanism 4 comprises a pair of first arms 51 and a pair of second arms 52. The first arms 51 are located within the second arms 52. A shaft 54 extends between the arms 51, 52 so they are pivoted at their midpoints. Each of the arms 51, 52 is widest at its midpoint and tapers towards its ends.

Lower ends 56 of the first arms 51 are connected to the pivot locations 16 by pivot pins. Upper ends of the first arms 51 are provided with rollers 58, which are engaged by the L-sectioned members 42. Correspondingly, upper ends 60 of the second arms 52 are connected by pivot pins to the pivot locations 40 of the top element 6. Lower ends of the second arms 52 are provided with rollers 62, which are engaged by the members 18, for horizontal movement. It will be seen that this mechanism ensures that the top element 6 is always maintained parallel to the base element 2. Even if an unbalanced load is applied to the top element 6, it will be held horizontal.

To actuate the scissor mechanism 4, the air piston and cylinder assemblies 8, 9 are connected to the arms 51, 52. The assembly 8 has a cylinder 64 pivotally connected to the first arms 51, approximately halfway between their lower ends and their midpoints. It also includes a piston 66 pivotally connected to the second arms 52 by means of a cross shaft 68. Again, this cross shaft 68 is located approximately halfway between the midpoint of the arms 52 and their upper ends. The air piston and cylinder assembly 9 has a cylinder 65 and a piston 67, which are similarly connected between the other ends of the arms 51, 52. A corresponding cross shaft 69 is provided between the upper ends of the first arms 51. This arrangement of the air piston and cylinder assemblies 8, 9 enables the actuating forces provided by them, to be applied in a mechanically advantageous manner. At the same time, the arrangement of the assemblies 8, 9 gives a movement of the top element 6, which is approximately twice the stroke of the air piston and cylinder assemblies 8, 9.

Figure 2:
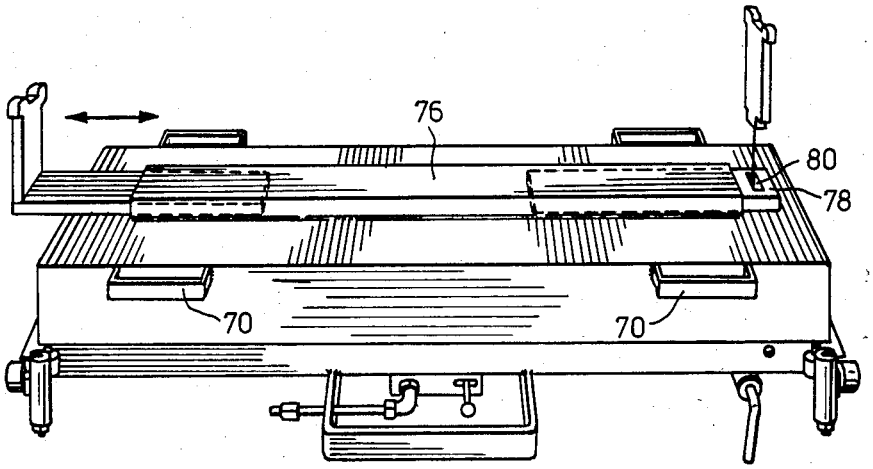
FIG. 2 shows a perspective view from above of the top element of the jack.

With reference to FIG. 2, the top element 6 includes elongate brackets 70, welded in position. The brackets 70 are for storing different supports 72, 74 as shown in FIG. 1. On top of the top element 6, a member 76 is welded, to form a shallow rectangular duct. Rectangular support plates 78 are then slotted into this duct. Each support plate 78 includes a rectangular opening 80, arranged to receive a corresponding shank portion 82 of a support 72, 74. In use, a number of different supports 72, 74 would be provided, to enable a variety of different vehicles to be lifted. For a particular vehicle, a pair of supports is chosen, and inserted in the openings 80. The rectangular plates 78 can then be adjusted laterally, to the desired position for lifting the vehicle.

Figure 3:
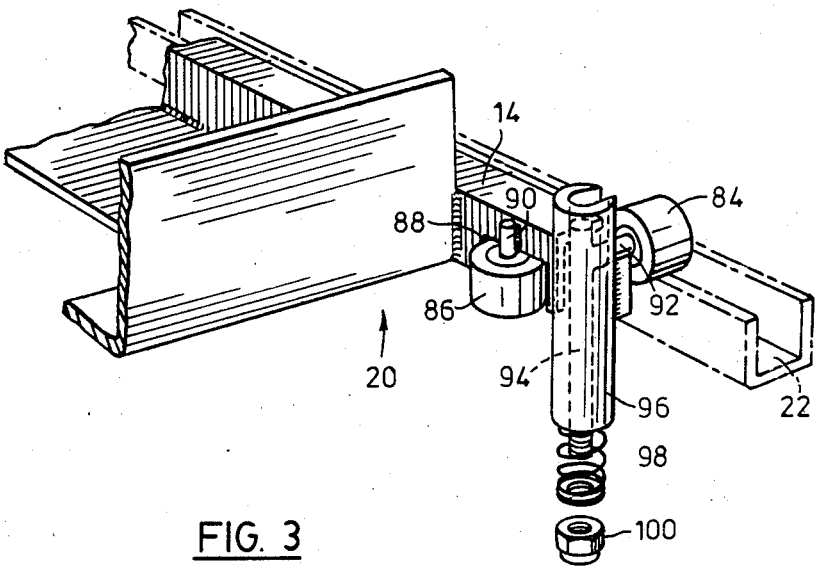
FIG. 3 shows a perspective view, on an enlarged scale, of a roller assembly of the jack.

With reference to FIG. 3, each of the roller assemblies 20 includes a horizontal roller 84, and a vertical roller 86; the designations horizontal and vertical being with respect to their axes. The vertical roller 86 is received in an opening 88 of the angle-section member 14, and is rotatably mounted on a shaft 90. The shaft 90 is welded to the angle-section member 14.

The horizontal roller 84 is rotatably mounted on a shaft 92, which is integral with a vertical rod 94. The rod 94 is received in a cylindrical body 96, which includes a side slot for the shaft 92. The cylindrical body 96 is also welded to the angle-section member 14. The rod 94 is threaded at its lower end. A spring, indicated at 98, is provided around the rod 94. A nut and washer 100 hold the spring in compression against on internal shoulder of the body 96. Consequently, the spring 96 urges the shaft 92 and roller 84 downwards.

All the roller assemblies 20 are generally identical. Compression springs 98 are so dimensioned as to support the load of the jack 1 by itself. Consequently, when unloaded, the members 14 are held above the channel-section members 22. It is then relatively easy for an operator to move the jack 1 along a lifting device. The rollers 84 take the weight of the jack 1, whilst the rollers 86 ensure that it will travel freely. Even if a force is just applied to one side of the jack 1, the rollers 86 should prevent it from coming jammed, and still ensure that it travels freely along the length of the lifting device.

In use, with a vehicle positioned on a lifting device, the jack 1 can be readily manoeuvered until it is beneath the jacking points of the vehicle. In this regard, the roller assemblies 20 ensure that the jack 1 can be readily pushed into position. In known arrangements, if a jack is not pushed or pulled exactly centrally, then it can twist and jam, rather than travelling freely.

Once the jack 1 is in position, the operator choses the required supports 72, 74. These are fitted into the openings 80 of the support plates 78. The support plates 78 are then pulled in or out, to put them in the correct lateral position. By means of the operating lever 34, the operator then actuates the air piston and cylinder assemblies 8, 9 to cause the scissor mechanism 4 to expand, thereby lifting the vehicle. Since both assemblies 8, 9 operate on one scissor mechanism 4, there is no need to provide a combiner and divider valve. As soon as the supports contact the vehicle and start to take the vehicle weight, the base element 4 is pressed down. The angle-section members 14 then contact the channel members 22. The jack 1 is then secured, and will not move. The vehicle can then be lifted to a desired height above the support platforms 21. As required, work can then be carried out on the wheels, suspension etc.

When the jack 1 is lowered, the roller mechanisms 20 will automatically lift the jack 1, when the vehicle weight is released. The jack 1 can then be freely moved again.

In contrast to known jacks which employ a large cylinder at an angle, this jack 1 has two cylinders which operate vertically. As the displacement of the air cylinders is amplified by their connection to the scissor mechanism 4, relatively short air piston and cylinders 8, 9 can be employed. Thus, cylinders having a 5½ inch travel can give a 9½ inch displacement of the top element 6. Since the piston and cylinder assemblies 8, 9 can be fairly short, their vertical mounting still permits the jack 1 to have a small vertical dimension, this being necessary for maneuvering the jack 1 under a vehicle. The openings 12 in the base element 2 also helps accomodate the cylinders and keep the height of the jack 1 to a minimum.

If required, a mechanism including a lever indicated at 36 can be provided for positively locking the jack 1 in position. For certain applications, it may be desirable to have a positive lock for the jack 1. The mechanism would lock the jack 1 to the support platforms 21.

If required, a mechanism including a lever indicated at 36 can be provided for positively locking the jack 1 in position. After the jack 1 has been raised, the lever is removed and inserted through openings 37. This then blocks the rollers 62, to prevent collapse of the jack. For example, if a vehicle is to be left elevated overnight, the locking lever 36 would be used, in case of air leakage ect.

In contrast to known designs, the jack 1 can be of very low height. As such, it can permit a vehicle to travel over it. As a consequence, unlike known designs, the jack does not have to be swung down out of the way, to permit the vehicle to be move.

The embodiments of the invention in which an exclusive property of privilege is claimed are defined as follows:

1. A jack for use with a lifting device including two parallel support platforms, the jack comprising a base element, a top element, a scissor mechanism between the base and top elements, at least one air piston and cylinder assembly for displacing the top element vertically relative to the base element, four roller assemblies at corners of the jack, each roller assembly comprising one vertical roller, for engaging a side of one support platform to guide the jack therebetween and a horizontal roller for engaging a top surface of a side of one support platform for horizontal movement of the jack, and spring biasing means mounting the horizontal rollers to the base element, the spring biasing means being such that, when a pre-determined load is applied to the jack, the base element is displaced downwards to contact the support platforms, thereby to restrict further horizontal movement of the jack.

2. A jack as claimed in claim 1, wherein the spring biasing means comprises a spring in each roller assembly, each spring biasing a respective horizontal roller vertically downwards.

3. A jack as claimed in claim 12, wherein, for each roller assembly, the spring comprises a compression spring around the respective rod, which acts on the cylinder and on a lower end of the rod.

4. A jack as claimed in claim 12, which includes side members, for contacting the support platforms of a lifting device, to which side members the roller assemblies are secured.

5. A jack as claimed in claim 4, wherein the side members comprise angle-section members.

6. A jack as claimed in claim 5, wherein each horizontal roller is provided in an opening in a vertical sidewall of a respective angle-section member.

7. A jack as claimed in claim 1, which includes two vertical and parallel air piston and cylinder assemblies.

8. A jack as claimed in claim 7, wherein the scissor mechanism comprises a pair of first levers and a pair of second levers pivotally attached at mid-points thereof, and wherein one piston and cylinder assembly is pivotally attached to the first levers generally equidistant between said mid-point and one end thereof, and to the second levers generally equidistant between said mid-point and one end thereof, and the second piston and cylinder assembly is pivotally attached to the first levers generally equidistant between said mid-point and the other end thereof, and to the second levers generally equidistant between said mid-point and the other end thereof, thereby to give a displacement of the top element which is greater than the displacement of the pistons.

9. A jack as claimed in claim 8, wherein the first and second leyers extend in vertical planes generally parallel to the axes of the horizontal rollers, and wherein said one ends of the second levers are pivotally attached to the top element, said other ends of the first levers are provided with rollers, which run in channels of the top element, and the other ends of the second levers are provided with rollers which run in channels of the base element.

10. A jack as claimed in claim 9, wherein the channels of the top and base elements are defined by L-shape members secured to the respective element.

11. A jack as claimed in claim 8, 9, or 10, wherein the cylinder of the first piston and cylinder assembly is pivotally attached at an upper end thereof to the first levers generally equidistant between said mid-point and one end of the first levers, and the cylinder of the second piston and cylinder assembly is pivotally attached at its upper end to the second levers generally equidistant between said mid-point and the other end thereof, and wherein the base element includes openings, to accomodate the cylinders of the piston and cylinder assemblies.

12. A jack for use with a lifting device including two parallel support platforms, the jack comprising: a base element; a top element; a scissor mechanism between the base and top elements; at least one air piston and cylinder assembly for displacing the top element vertically relative to the base element; four roller assemblies at corners of the jack, each roller assembly comprising a cylinder fixed to the base element with its axis vertical,a rod slidably mounted in the cylinder, a horizontal shaft extending out from the rod, a spring urging that rod downwards, a vertical roller for engaging a side of the support platform to guide the jack therebetween and a horizontal roller mounted on the horizontal shaft for engaging a top surface of a side of one support platform for horizontal movement of the jack, the springs of the roller assemblies being such that, when a pre-determined load is applied to the jack, the base element is displaced downwards to contact the support platforms, thereby to restrict further horizontal movement of the jack.

* * * * *